United States Patent [19]

Werner

[11] 4,258,455

[45] Mar. 31, 1981

[54] METHOD FOR CLASSIFYING FIBERS

[75] Inventor: Edward E. Werner, Oshkosh, Wis.

[73] Assignee: Kimberly-Clark Corporation, Neenah, Wis.

[21] Appl. No.: 4,597

[22] Filed: Jan. 18, 1979

Related U.S. Application Data

[62] Division of Ser. No. 888,659, Mar. 21, 1978, Pat. No. 4,169,699.

[51] Int. Cl.[3] ..... B29C 13/00

[52] U.S. Cl. ..... 19/303; 19/200; 19/305; 19/308; 425/83.1

[58] Field of Search ..... 425/83.1; 19/305, 308, 19/303, 200, 202, 107; 264/503

[56] References Cited

U.S. PATENT DOCUMENTS

| | | | |
|---|---|---|---|
| 2,751,633 | 6/1956 | Clark | 425/83.1 |
| 2,827,668 | 3/1958 | Clark | 425/83.1 X |
| 2,912,723 | 11/1959 | Roberts | 425/83.1 X |
| 2,919,475 | 1/1960 | Heppenstall et al. | 19/303 X |
| 2,931,076 | 4/1960 | Clark | 425/83.1 X |
| 2,940,133 | 6/1960 | Heritage | 425/83.1 X |
| 3,029,478 | 4/1962 | Vandergriff | 19/202 |
| 4,030,865 | 6/1977 | Kobayashi | 425/83.1 X |
| 4,035,121 | 7/1977 | Wood | 425/83.1 |
| 4,051,576 | 10/1977 | Raburin et al. | 425/83.1 |
| 4,144,619 | 3/1979 | White et al. | 19/305 X |

*Primary Examiner*—Louis Rimrodt

*Attorney, Agent, or Firm*—Stephen R. May; William D. Herrick

[57] ABSTRACT

A process and mechanism for the dry screen forming of fibers to attain a dispersion in air of substantially individual fibers from which a fibrous sheet is formed. Fibrous nits, pills and flocs are removed from the dispersion by rolling the nits, pills and the like into elongated shapes as they pass a fiber screening member and carrying the elongated fibrous bodies from the dispersion of fibers and away from the sheet forming area for the fibers. The mechanism includes a fiber screening member, a fiber receiving member on which the sheet is formed and a foraminous member which rolls the nits, pills and the like between it and the fiber screening member as the air dispersion of fibers passes toward the fiber receiving member.

4 Claims, 6 Drawing Figures

METHOD FOR CLASSIFYING FIBERS

This is a Divisional Application to my co-pending U.S. patent application, entitled APPARATUS FOR CLASSIFYING FIBERS, Ser. No. 888,659, filed Mar. 21, 1978, now issued as U.S. Pat. No. 4,169,699 granted Oct. 2, 1979.

This invention relates to the air-forming of sheets of fibers, or batts of fibers, from a source of dry fibers and is particularly concerned with process and apparatus for removing nits, pills, fiber flocs and the like from a dispersion of the fibers in air as they pass to a receiving member for sheet formation.

It has been common practice to disintegrate the pulp from a pulp mill into fibers. Such fibers have been conveyed through pipe systems with the aid of blowers to a source point for fiber deposit and sheet formation. Various mechanisms have been employed to effect the fiber deposit in an attempt to attain control of fiber laydown and achieve a uniform sheet thickness. Many of these prior art mechanisms involve what may be termed a sifting device, that is, an agitator positioned above an apertured plate or screen for urging fibers through the screen; fibers which pass the screen are collected on a receiving member usually in the form of a traveling wire. Such sifting devices rely on the agitator and sifting operation to break up nits which are small balls of fibers occurring in the pulp sheets. However, this has been found to be relatively ineffective for nit removal and many nits find their way through the screen to be included in the forming sheet. Additionally, the action of the agitator tends to compact fibers together into pills, and these too tend to pass with the nits and other more loose flocs of fibers to the finished sheet. In the operation of these prior art formers the tendency is to operate at lower differential air pressures across the fiber screening member-fiber receiving member combination in order to assist the attempted breakup of nits and the like; this mode of operation leads, however, to a lowered fiber throughput of the fiber screening member and, consequently, low rates of sheet formation.

It is a primary object of this invention to overcome difficulties attendant the use of prior art mechanisms.

A particular object of the invention is the provision of a process for the forming of fiber dispersions in air in a manner which minimizes the fiber clots or clusters present in the dispersion as it passes to a fiber receiving member.

Yet another object of the invention is the provision of a process for fiber sheet or batt formation from a source of fibers which permits the attainment of good rates of fiber throughput and sheet formation.

A further object of the invention is the provision of improved sheet quality by minimizing of the presence of fiber nits, fiber pills and fiber flocs in the final product.

The invention contemplates that the difficulties attendant nit and pill removal and the like, together with very suitable rates of fiber throughput to attain good speed of sheet formation, may be overcome by a treatment of the fiber dispersion containing the nits and pills after the dispersion has passed the screening member. The treatment involves causing a rolling action on the dispersed fibers whereby the nits, pills and the like become elongated while there is little noticeable effect on the desired individual fibers. The rolling action is carried out so that some pressure exists on the nits, pills and fiber flocs, thereby encouraging a change of shape of those undesired fiber clots. The rolling action is achieved by traversing a foraminous member across the outlet of the fiber screening member. The foraminous member receives and retains fiber clusters or clots which pass the fiber screening member while individual fibers and the like pass the foraminous member to the fiber receiving member. The movement of the foraminous member relative to the screen member not only rolls the clusters to elongated shapes but carries the undesired clots from the area of the fiber receiving member. In a preferred practice of the invention the removed fiber clots are recycled to a fiberizer for further refining and reuse of the fibers.

The invention will be more fully understood by reference to the following detailed description and accompanying drawings wherein.

Figure 1:
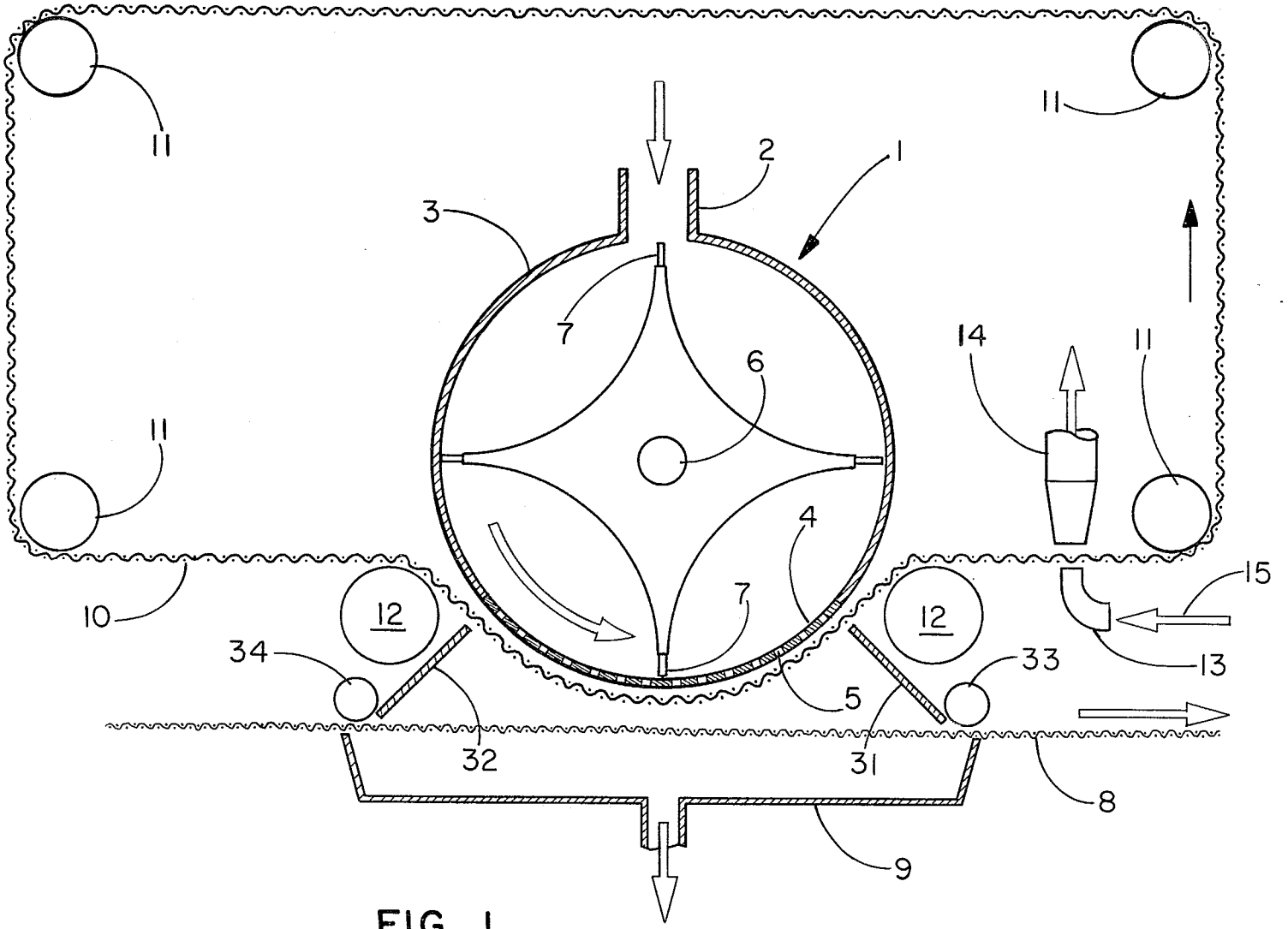
FIG. 1 is a schematic view in side elevation of apparatus useful in carrying out the invention.

Referring to the drawings in more detail, the numeral 1 in FIG. 1 designates a generally cylindrical forming head to which a flow of fibers and air is introduced through conduit portion 2. The fiber-air flow is generated in any conventional manner as by a hammermill (not shown) acting on pulp sheets to reduce them to fibers and then conveying of the fibers by a blower and conduit arrangement. The forming head 1 further includes an impervious wall portion 3 integral with conduit 2, and a fiber screening member 4 in the form either of a foraminous plate or a wire mesh which extends transversely across the bottom of the forming head and in side elevation, as shown in FIG. 1, is arcuate. The screening member is, in the specific embodiment shown in end view, a portion of a sphere. This fiber screening member is fixed in position, is relatively rigid and has a plurality of openings 5.

The forming head has a (FIG. 1) central longitudinally extending shaft 6 which mounts a plurality of bars 7 to form an agitator for the fiber-air stream. These bars extend longitudinally with the forming head and are suitably spaced slightly above the screening member. These bars may, if desired, be positioned to wipe across the interior of the screening member but contact with the member is not necessary. In the operation of the bars, fiber nits which are small, hard masses of fiber that have not been broken up in the hammermill treatment are struck by the bars and some may be defibered. However, it has been found that the tendency is for such nits to remain in the moving fiber and to be carried through the screening member when made small enough. Also, it has been found that the action of the bars tends to cause small pills to form which pass the screening member and become incorporated in the final sheet or batt.

The screening member 4 is commonly formed with a relatively large open area. This is desirable in order that a relatively large quantity of fiber may pass the screening member per unit time to attain fiber deposition rates suitable for commercial production. Typically, a screening member has a plate thickness of about 0.062 inch, a plate hole size of 0.093 inch in diameter and plate open area of about 45%. While such a plate or screening member permits good fiber throughput as to quantity, the tendency to pass fiber clusters such as pills, nits and fiber flocs is present. It is, therefore, highly desirable to remove the nits, pills and flocs from the fiber air stream while maintaining adequate fiber throughput. A range of 10–16 mesh for the screening member at a wire diameter of about 0.018 inch is suitable for many purposes including production of a sheet having a basis weight of about 17 pounds per 2880 square feet.

In the prior art arrangements the fiber air stream flows from the screening member 4 to a receiving member wire 8 which is arranged to traverse a suction box as at 9 in known manner. A suction pressure in box 9 of about 0.25 inch of water assists the fiber-air flow to the receiving wire 8 and removes the air from the stream. The fiber is deposited on wire 8 in random fashion and any nits, pills or flocs present are incorporated in the forming sheet.

The present invention provides a foraminous member 10 operable to traverse the outlet of the screening member 4 and to receive and retain fiber clusters which may pass the screening member 4. Movement of the foraminous member relative to the screening member rolls the fiber clusters to an elongated shape which inhibits their passage of the foraminous member to the receiving member 8. Additionally, the movement of the foraminous member carries the clusters away from the receiving member.

Figure 2:
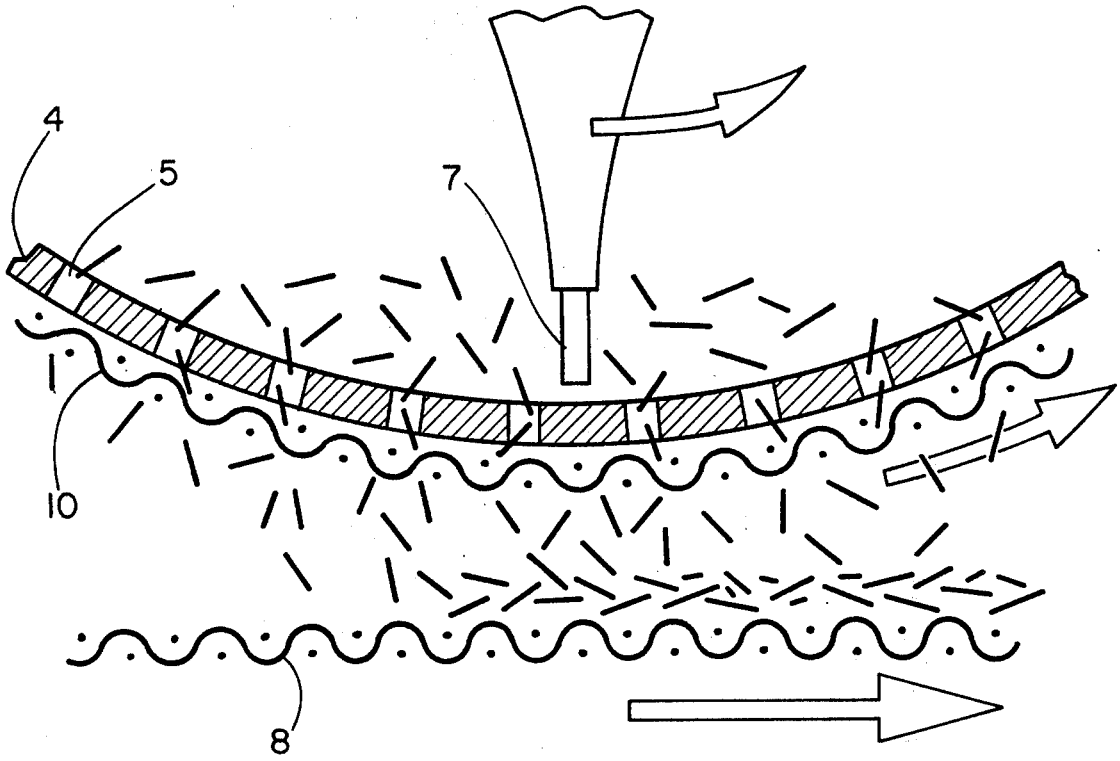
FIG. 2 is a fragmentary and much enlarged view of a portion of the apparatus of FIG. 1.

As illustrated in FIGS. 1 and 2, the foraminous member 10 is a continuous screen supported for movement by a plurality of turning rolls 11 and guide rolls 12. The foraminous member is at least as open and preferably is more open than the plate of the screening member. Suitably, at a 50% plate open area the foraminous member is 65% or more open. Rolls 12 permit positioning of the screen closely adjacent to the outlet of screening member 4 and suitably the screen in the inoperative position bears lightly against the screening member. The direction of traverse of the foraminous member is indicated by an arrow in FIG. 1. The member 10 as it exits from the screening member-receiving member area is directed between elements 13,14 of a conduit system. As indicated by the arrow at 15, a flow of air may be directed through the lower conduit 13, through the foraminous member 10 to the conduit 14 to cause the elongated fiber clusters to be removed from the member 10 and carried into conduit 14. Conduit 14, as indicated by the legend (FIG. 1), serves to direct the fiber clusters to a fiberizer for fiberizing and return to the system at conduit 2. Such recycling operation is a well-known fiber recovery procedure. The foraminous member may be driven by any convenient source of power (not shown).

A very suitable foraminous member for cooperation with the specific screening member mentioned before herein has a mesh of about 14 at an open area of about 65%. Such a member 10, when operated at a speed of about 225 feet per minute and with a speed of shaft 6 of about 1610 revolutions per minute, corresponding to a peripheral rotor speed of 2528 feet per minute, was found to be very effective in fiber cluster removal. It is desirable to maintain a good speed of the foraminous member to maintain the openings of the screening member clear as this yields improved throughput and reduces quantity of recycles. In addition to fiber cluster removal, the capacity of the device is increased apparently because the expedient removal of the clusters presents greater opportunity for individual fiber passage to the receiving screen. Additionally, reliance on the agitator to break up nits and to avoid pill formation is no longer a pertinent factor and the pressure drop across the forming head to the suction box may be increased further, facilitating individual fiber flow.

Figure 3:
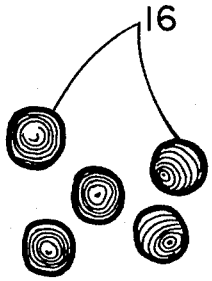
FIG. 3 is a representation of a fiber cluster, that is, a fiber nit, pill, floc or the like before treatment in accordance with the present invention.
Figure 4:
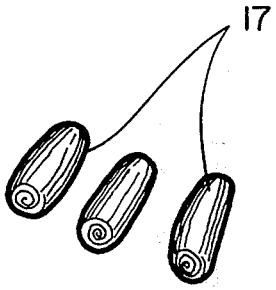
FIG. 4 is a representation of the fiber cluster of FIG. 3 following treatment in accordance with the present invention.

FIG. 3 illustrates at 16 the shape of the usual pills or nits or fiber flocs occurring in the forming head and sometimes in the openings of the screening member. In FIG. 4 at 17 the elongated product of the rolling action occurring between the foraminous screen member 10 and the outlet side of the screening member is shown. The elongated product attains a size rather readily which prevents its passage of the foraminous member while yet maintaining it sufficiently free that removal by an air blast is accomplished easily.

Figure 5:
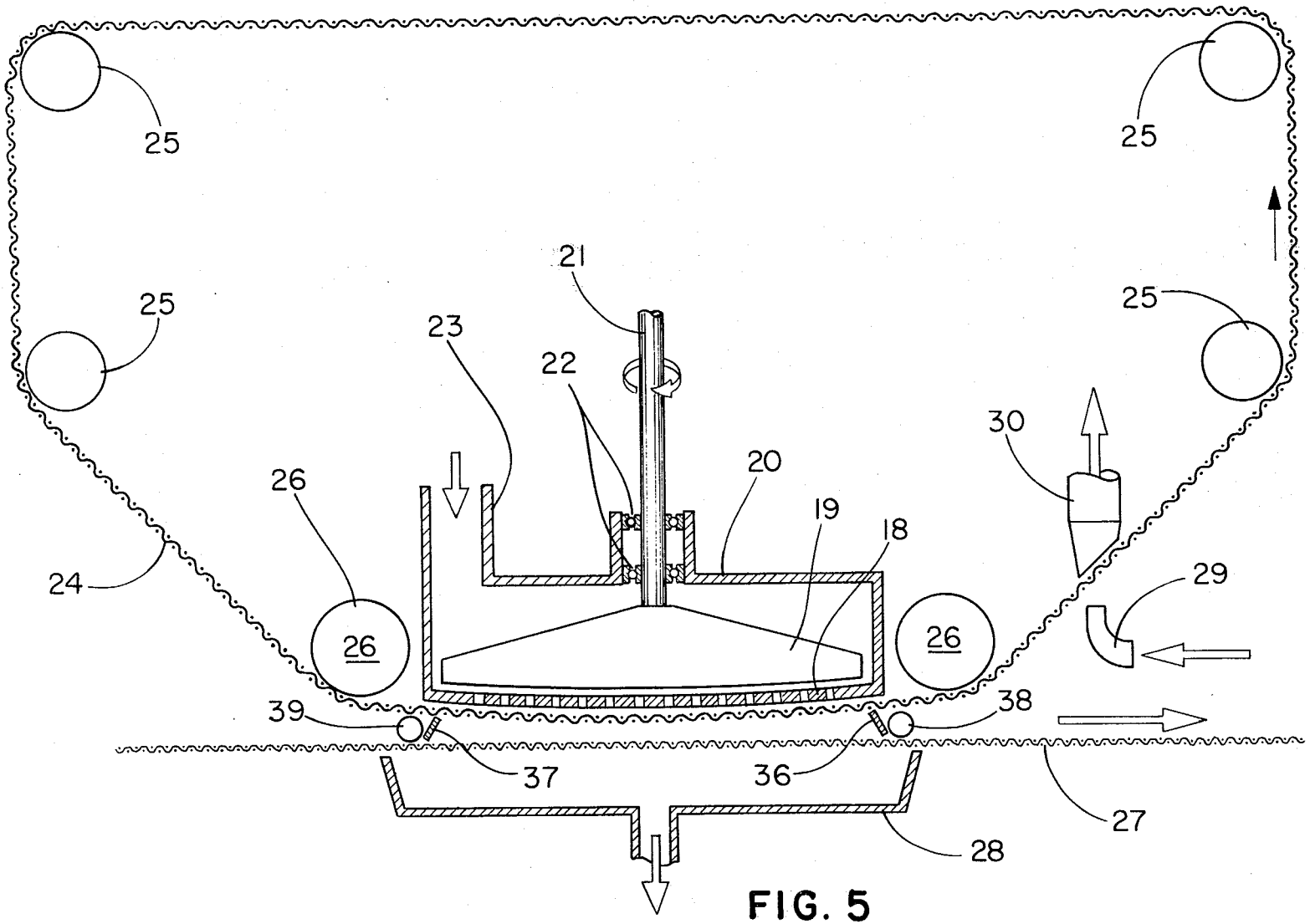
FIG. 5 is a schematic view in side elevation similar to FIG. 1 and of a further embodiment of the invention.
Figure 6:
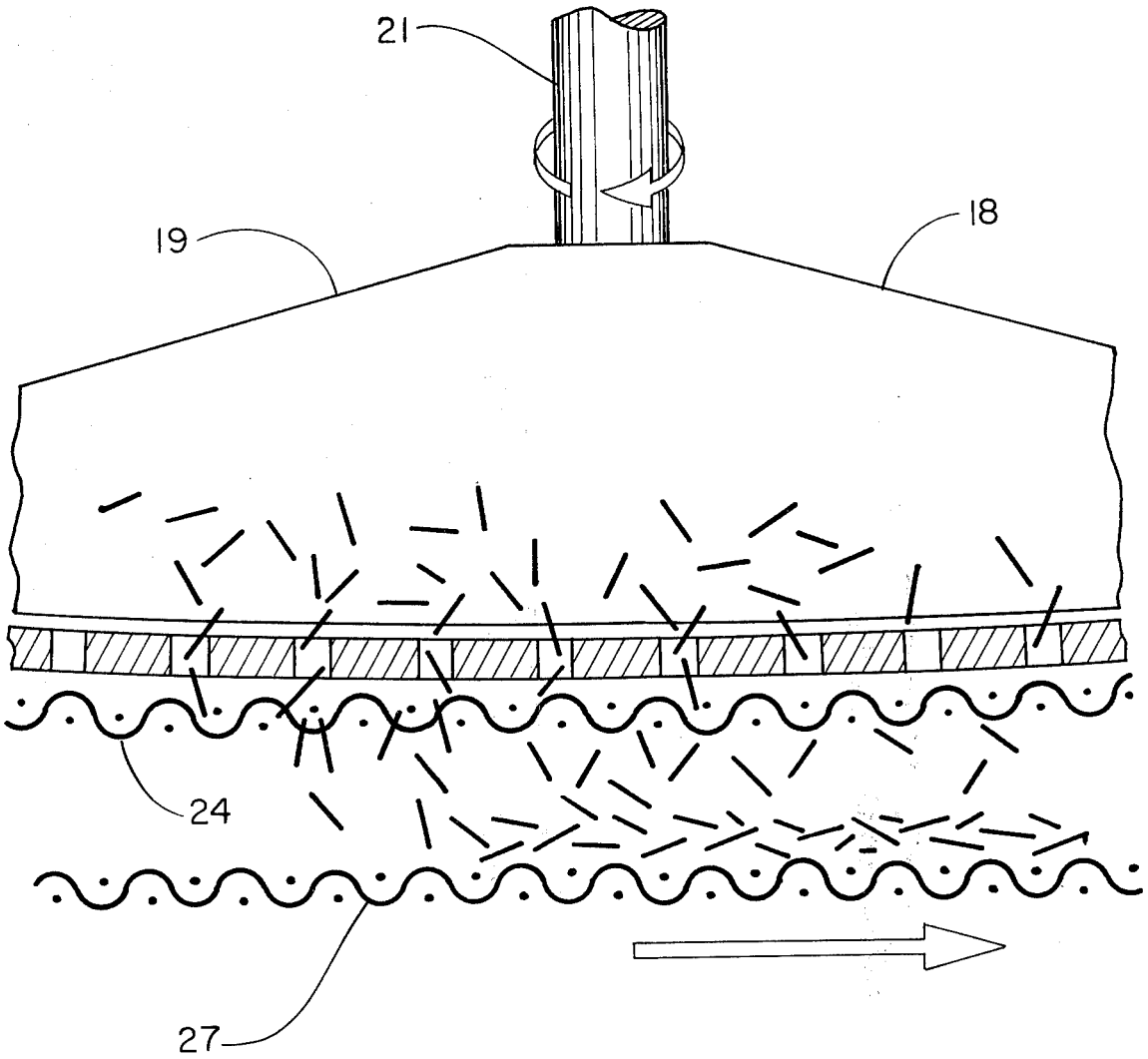
FIG. 6 is a fragmentary view of a further embodiment of the invention and similar to the view of FIG. 2 but with an essentially planar fiber screening member.

A further embodiment of the invention is illustrated in FIGS. 5 and 6. This arrangement is characterized by an essentially planar screening member 18. The agitator 19 mounted closely above the screening member 18 in the housing 20 is supported on the extremity of vertical shaft 21 rotatably mounted in bearings 22. In this instance the fiber-air stream is introduced at an offset conduit 23. The foraminous member is designated at 24 and is supported by turn rolls 25 and guided by rolls 26. The receiving wire 27 is positioned below the foraminous member 24 and over the suction box 28. The numerals 29,30 designate conduit portions on either side of the foraminous member 24 for effecting fiber recycle in a manner already mentioned. While the screening member 18 may be planar, it has been found desirable from an operating point of view to contour the screening member slightly as indicated to permit easy traversing movement of the foraminous member. A very slight arc of the screening member serves the purpose.

In the embodiment of FIG. 1 the forming head 1 is cylindrical and of the general type shown in U.S. Pat. No. 2,698,271. The control of flow of air is carried out in known manner from the forming head to the receiving member 8 and suction box 9. For the purpose of air flow control there is provided a forward baffle 31, a rearward baffle 32 and sealing rolls 33,34. The baffles and rolls extend longitudinally parallel to the axis of the cylindrical forming head and parallel with the width direction of the forming wire 8. This arrangement inhibits the lateral flow of air to the receiving member from outside the system and aids uniform fiber deposition.

In FIG. 5 the structural arrangement of the housing 20 is similar to that in U.S. Pat. No. 3,581,706. The forward baffle 36, the rearward baffle 37 and sealing rolls 38,39 serve the same purpose of limiting unwanted air entry to the fiber deposition zone on the traveling receiving wire 27.

As many apparently widely different embodiments of this invention may be made without departing from the spirit and scope thereof, it is to be understood that I do not limit myself to the specific embodiments thereof except as defined in the appended claims.

I claim:

1. In a process for removing nits, pills, fiber flocs and the like from a dispersion of fibers utilized in the production of a paper sheet, the steps of sifting fibers through a fiber screening member toward a fiber receiving member on which a sheet is to be formed, and rolling up clumps of fibers which pass the screening member to an elongated shape after they exit from the screening member, and carrying the rolled-up elongated clumps of fibers from the area of the fiber receiving member and from the fibers which pass to the receiving member.

2. The process of claim 1 wherein the rolling up of the clumps of fibers to an elongated shape is effected by a foraminous moving member traversing the screening member so that the rolling up action takes place between the members.

3. The process of claim 2 wherein the sifting of the fibers through the screening member to the fiber receiving member and the rolling up of clumps of fibers to the elongated shape is carried out under the influence of a vacuum directed to drawing the fibers through the screening member and foraminous member.

4. The process of claim 2 wherein the screening member is traversed continuously by the foraminous member and said foraminous member is freed of fiber clumps prior to each traverse.

* * * * *